US011474479B2

(12) United States Patent
Nomura et al.

(10) Patent No.: US 11,474,479 B2
(45) Date of Patent: Oct. 18, 2022

(54) HAIRSPRING, BALANCE WITH HAIRSPRING, TIMEPIECE MOVEMENT, AND TIMEPIECE

(71) Applicant: Seiko Instruments Inc., Chiba (JP)

(72) Inventors: Hiroshi Nomura, Chiba (JP); Takayoshi Ibata, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 387 days.

(21) Appl. No.: 16/787,603

(22) Filed: Feb. 11, 2020

(65) Prior Publication Data

US 2020/0264562 A1 Aug. 20, 2020

(30) Foreign Application Priority Data

Feb. 15, 2019 (JP) ..... JP2019-025318

(51) Int. Cl.
*G04B 17/06* (2006.01)

(52) U.S. Cl.
CPC ..... *G04B 17/063* (2013.01)

(58) Field of Classification Search
CPC ..... G04B 17/06; G04B 17/063; G04B 17/066
See application file for complete search history.

(56) References Cited

U.S. PATENT DOCUMENTS 109,826 A * 12/1870 Kline ..... G04B 17/066 368/175
5,907,524 A 5/1999 Marmy et al.
8,322,914 B2 * 12/2012 Bifrare ..... G04B 17/227 368/177
8,562,206 B2 * 10/2013 Bossart ..... G04B 17/066 368/175
8,764,281 B2 * 7/2014 Zaugg ..... G04B 17/066 368/175

(Continued)

FOREIGN PATENT DOCUMENTS

CN 104049519 A 9/2014
DE 102009048733 A1 4/2011

(Continued)

OTHER PUBLICATIONS

English translation of First Office Action in China Application No. 202010092662.1, dated Feb. 25, 2022, 5 pages.

(Continued)

*Primary Examiner* — Sean Kayes
(74) *Attorney, Agent, or Firm* — Crowell & Moring LLP

(57) ABSTRACT

There is provided a hairspring including a main body portion that extends around a central axis along an Archimedes curve; an outer end curve portion that extends along a circumferential direction around the central axis on an outer side in a radial direction from the main body portion; and a reformed portion including a first bent portion that connects the main body portion and the outer end curve portion to each other and is bent outward in the radial direction from a tangent line of the Archimedes curve in a first connection portion with the main body portion, and a second bent portion bent inward in the radial direction from the outer end curve portion in a second connection portion with the outer end curve portion, and in which at least one is curved of the first bent portion and the second bent portion.

7 Claims, 11 Drawing Sheets

(56) References Cited

U.S. PATENT DOCUMENTS

| | | | | |
|---|---|---|---|---|
| 2002/0167865 | A1* | 11/2002 | Tokoro ..... | G04B 17/066<br>368/175 |
| 2019/0212702 | A1 | 7/2019 | Semon et al. | |

FOREIGN PATENT DOCUMENTS

| | | | |
|---|---|---|---|
| EP | 1256854 | A2 | 11/2002 |
| EP | 1256854 | A3 | 11/2002 |
| EP | 1431844 | A1 | 6/2004 |
| FR | 3052881 | A1 | 12/2017 |
| JP | 2013-210386 | A | 10/2013 |

OTHER PUBLICATIONS

Extended European Search Report in Europe Application No. 20156123.0, dated Jun. 24, 2020, 7 pages.
Jendritzke H Ed., "Le regalage d' une montre a balancier spiral", dated Jan. 1, 1961, Reglage D'Une Montre A Balancier Spiral, Lausanne, Scriptar, CH, XP002266616, 1 page.

* cited by examiner

HAIRSPRING, BALANCE WITH HAIRSPRING, TIMEPIECE MOVEMENT, AND TIMEPIECE

RELATED APPLICATIONS

This application claims priority to Japanese Patent Application No. 2019-025318 filed on Feb. 15, 2019, the entire content of which is incorporated herein by reference.

BACKGROUND OF THE INVENTION

1. Field of the Invention

The present invention relates to a hairspring, a balance with a hairspring, a timepiece movement, and a timepiece.

2. Description of the Related Art

In a mechanical timepiece, it is important that a balance with a hairspring has a vibrating period set within a predetermined specified value. This is because, when the vibrating period deviates from the specified value, the rate (timepiece delay, degree of advancement) of the mechanical timepiece changes. As a method for adjusting the rate, generally, a method for adjusting the length (effective length) of a hairspring with an inner end fixed to a balance staff of the balance with a hairspring and an outer end fixed to a stud using a regulator is known.

The metal hairspring has a spiral part along an Archimedes curve, and an outer end curve portion that is spaced to an outer side in a radial direction from an outer end portion of the spiral part via a reformed portion and extends with a certain curvature (for example, refer to JP-A-2008-309802). The outer end curve portion is engaged with the stud that fixes the outer end of the hairspring, the regulator that adjusts the effective length of the hairspring, and the like.

There is a case where the hairspring is plastically deformed when an impact is applied to cause contact with other components or self-contact, and the isochronism of vibrating period and rate is disturbed. In particular, in a case where the reformed portion has a small bending point with a curvature, stress is likely to concentrate when an impact is applied to the hairspring, and there is a possibility of plastic deformation.

In the technique described in JP-A-2008-309802, in order to improve the resistance against permanent deformation of the hairspring, heat treatment is applied to an outer end region of the hairspring to remove internal stress.

However, in the technique described in JP-A-2008-309802, the manufacturing cost increases due to the addition of heat treatment when manufacturing the hairspring. Therefore, there is a problem in that deformation due to stress concentration is suppressed while suppressing an increase in manufacturing cost of the hairspring.

SUMMARY OF THE INVENTION

It is an aspect of the present application to provide a hairspring, a balance with a hairspring, a timepiece movement, and a timepiece in which deformation due to stress concentration is suppressed while suppressing an increase in manufacturing cost.

According to another aspect of the present application, there is provided a hairspring including a main body portion that extends around a central axis along an Archimedes curve; an outer end curve portion that extends along a circumferential direction around the central axis on an outer side in a radial direction from the main body portion; and a reformed portion including a first bent portion that connects the main body portion and the outer end curve portion to each other and is bent outward in the radial direction from a tangent line of the Archimedes curve in a first connection portion with the main body portion, and a second bent portion bent inward in the radial direction from the outer end curve portion in a second connection portion with the outer end curve portion, and in which at least one is curved of the first bent portion and the second bent portion.

According to the application, by forming the reformed portion including the first bent portion and the second bent portion, for example, by performing bending processing or the like with respect to a part of a spiral thin plate spring, it is possible to provide the outer end curve portion spaced to the outer side in the radial direction from the main body portion in an outermost circumferential portion of the hairspring as a part engaged with a regulator or the like. In such a configuration, since at least one of the first bent portion and the second bent portion is curved, compared to a case where the first bent portion and the second bent portion are bent, it is possible to suppress stress concentration generated in the reformed portion. Therefore, it is possible to provide a hairspring in which deformation due to stress concentration is suppressed while suppressing an increase in manufacturing cost due to addition of heat treatment or the like.

In the hairspring, at least one of the first bent portion and the second bent portion may be curved with a certain curvature.

According to the application, the stress generated in at least one curved portion of the first bent portion and the second bent portion can be dispersed substantially evenly in a curved range with a certain curvature. Therefore, the deformation of the hairspring due to stress concentration can be more reliably suppressed.

In the hairspring, both the first bent portion and the second bent portion may be curved.

According to the application, stress concentration can be suppressed in both the first bent portion and the second bent portion. Therefore, the deformation of the hairspring due to stress concentration can be more reliably suppressed.

In the hairspring, the first bent portion and the second bent portion may be connected to each other.

According to the application, since the entire reformed portion is a curved bent portion, the stress generated in the reformed portion can be dispersed to the entire reformed portion. Therefore, the deformation of the hairspring due to stress concentration can be more reliably suppressed.

According to the application, there is provided a balance with a hairspring including the hairspring; a balance staff fixed to an inner end portion of the hairspring; and a balance wheel fixed to the balance staff.

According to the application, since the hairspring is provided that suppresses deformation due to stress concentration while suppressing an increase in manufacturing cost, a high-quality balance with a hairspring can be provided at a low cost with less variation in rate due to deformation of the hairspring.

According to the application, there is provided a timepiece movement including the balance with a hairspring.

According to the application, there is provided a timepiece including the timepiece movement.

According to the application, since a high-quality and inexpensive balance with a hairspring with less variation in rate is provided, a high-quality timepiece movement and timepiece with little time error can be provided at low cost.

According to the application, it is possible to provide a hairspring in which deformation due to stress concentration is suppressed while suppressing an increase in manufacturing cost.

DETAILED DESCRIPTION OF THE PREFERRED EMBODIMENTS

Figure 1:
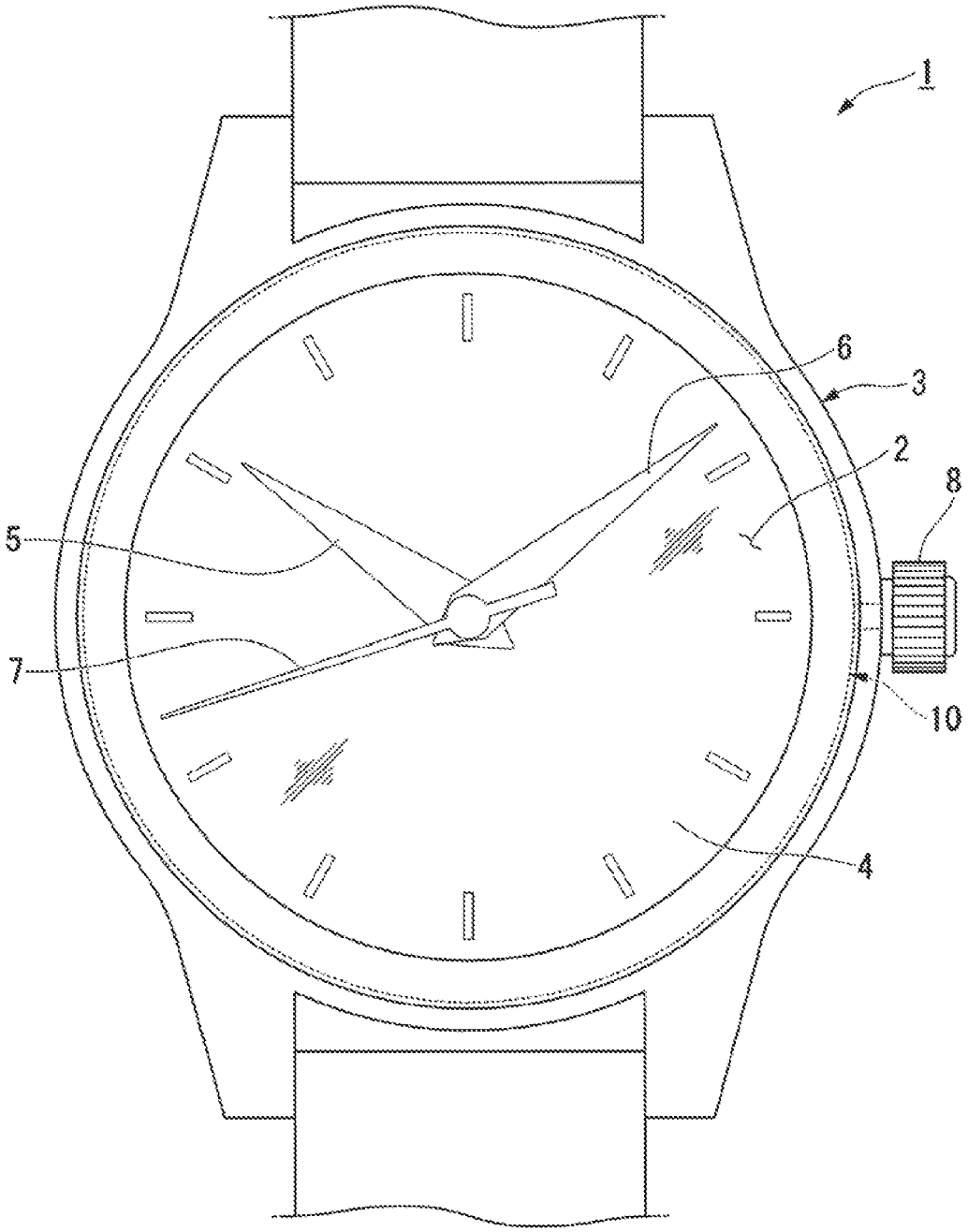
FIG. 1 is an external view of a timepiece according to a first embodiment.

Hereinafter, embodiments of the invention will be described with reference to the drawings. In addition, in the following description, the same reference numerals will be given to configurations having the same or similar functions. In addition, there is a case where overlapping description of the configurations is omitted.

First Embodiment

FIG. 1 is an external view of a timepiece according to a first embodiment.

As illustrated in FIG. 1, a timepiece 1 of the embodiment includes a movement 10 (timepiece movement), a dial 4 having a scale that indicates at least information regarding time, and an hour hand 5 that indicates the hour, a minute hand 6 that indicates the minute, and a second hand 7 that indicates the second, within a timepiece case 3 including a case back lid (not illustrated) and a glass 2.

Figure 2:
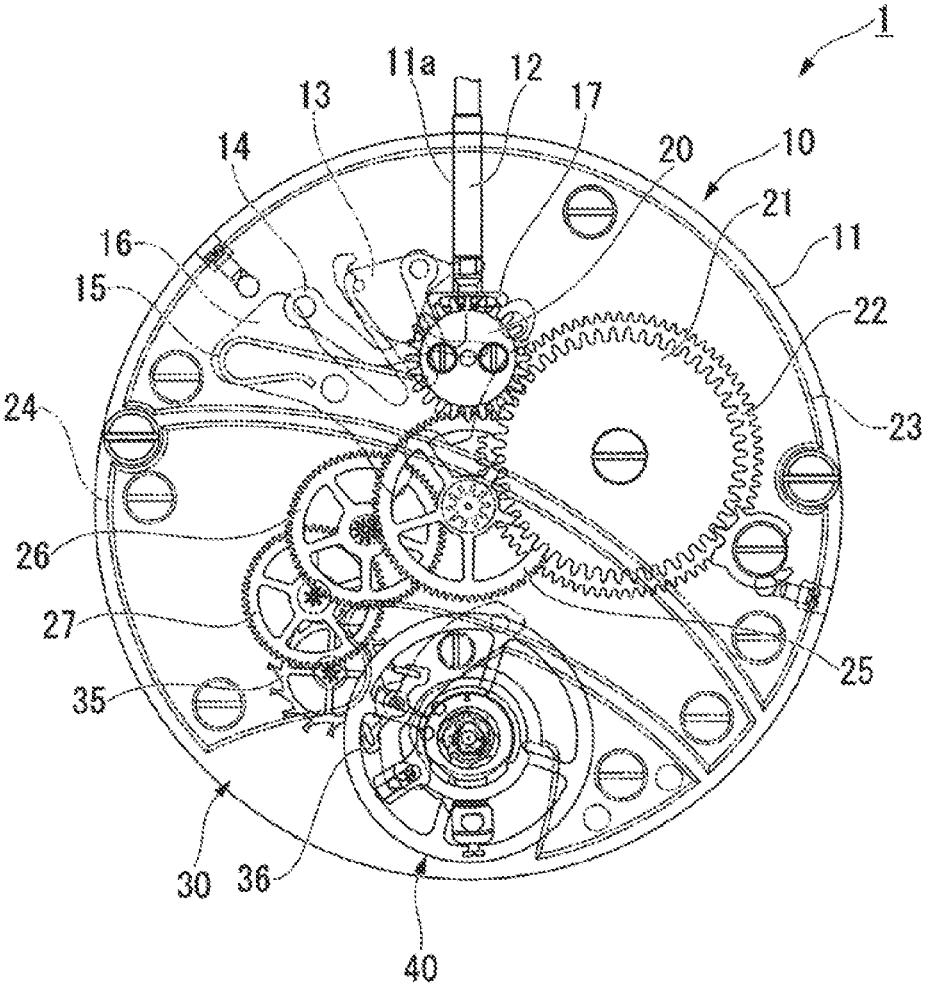
FIG. 2 is a plan view of a movement according to the first embodiment.

FIG. 2 is a plan view of a movement according to the first embodiment.

As illustrated in FIG. 2, a movement 10 has a main plate 11 that configures a board. A winding stem guide hole 11*a* is formed on the main plate 11. A winding stem 12 coupled to a crown 8 illustrated in FIG. 1 is rotatably incorporated in the winding stem guide hole 11*a*. The position of the winding stem 12 in a shaft direction is determined by a switching device having a setting lever 13, a yoke 14, a yoke spring 15, and a setting lever jumper 16. In addition, a winding pinion 17 is rotatably provided in a guide shaft portion of the winding stem 12.

Under such a configuration, when the winding stem 12 is rotated, the winding pinion 17 is rotated through the rotation of a clutch wheel (not illustrated). When the winding pinion 17 rotates, a crown wheel 20 and a ratchet wheel 21 rotate in order, and a hairspring (not illustrated) accommodated in a movement barrel 22 is wound up. In addition, the movement barrel 22 is pivotally supported between the main plate 11 and a barrel bridge 23.

A center wheel & pinion 25, a third wheel & pinion 26, a second wheel & pinion 27, and an escape wheel & pinion 35 are pivotally supported between the main plate 11 and a train wheel bridge 24. When the movement barrel 22 is rotated by a restoring force of the hairspring, the center wheel & pinion 25, the third wheel & pinion 26, and the second wheel & pinion 27 are configured to be rotated in order. The movement barrel 22, the center wheel & pinion 25, the third wheel & pinion 26, and the second wheel & pinion 27 configure a front train wheel.

When the center wheel & pinion 25 rotates, a cannon pinion (not illustrated) rotates based on the rotation, and the minute hand 6 (refer to FIG. 1) attached to the cannon pinion displays "minute". In addition, when the cannon pinion rotates, an hour wheel (not illustrated) rotates via a minute wheel (not illustrated), and the hour hand 5 (refer to FIG. 1) attached to the hour wheel displays "hour". Further, when the second wheel & pinion 27 rotates, the second hand 7 (refer to FIG. 1) attached to the second wheel & pinion 27 displays "second".

On the front side of the movement 10, an escapement & speed adjustment mechanism 30 for controlling the rotation of the front train wheel are disposed. The escapement & speed adjustment mechanism 30 includes the escape wheel & pinion 35 that meshes with the second wheel & pinion 27, a pallet fork 36 that makes the escape wheel & pinion 35 escape and rotate regularly, and a balance with a hairspring 40. Hereinafter, the structure of the balance with a hairspring 40 will be described in detail.

Figure 3:
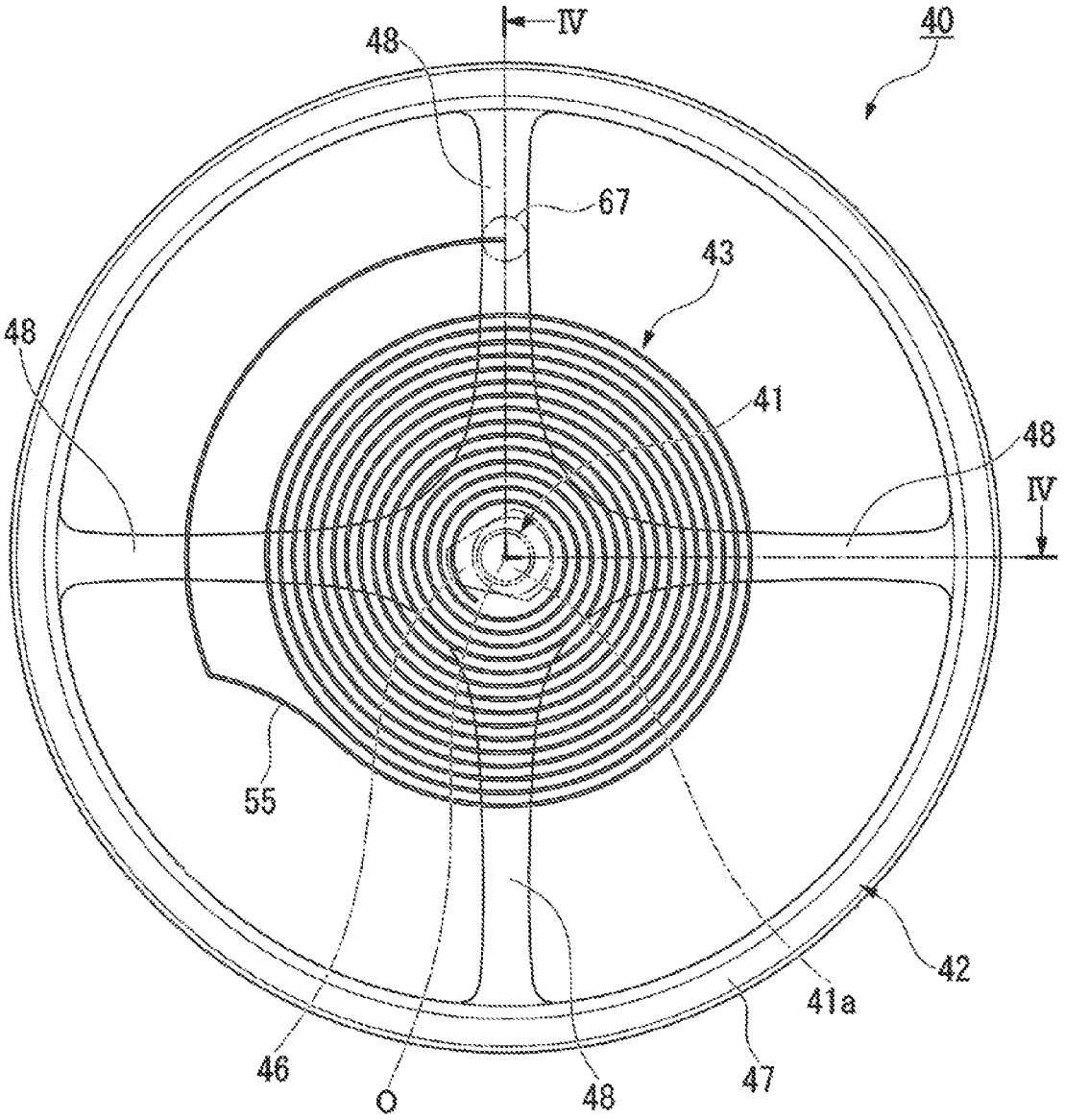
FIG. 3 is a plan view of a balance with a hairspring according to the first embodiment.
Figure 4:
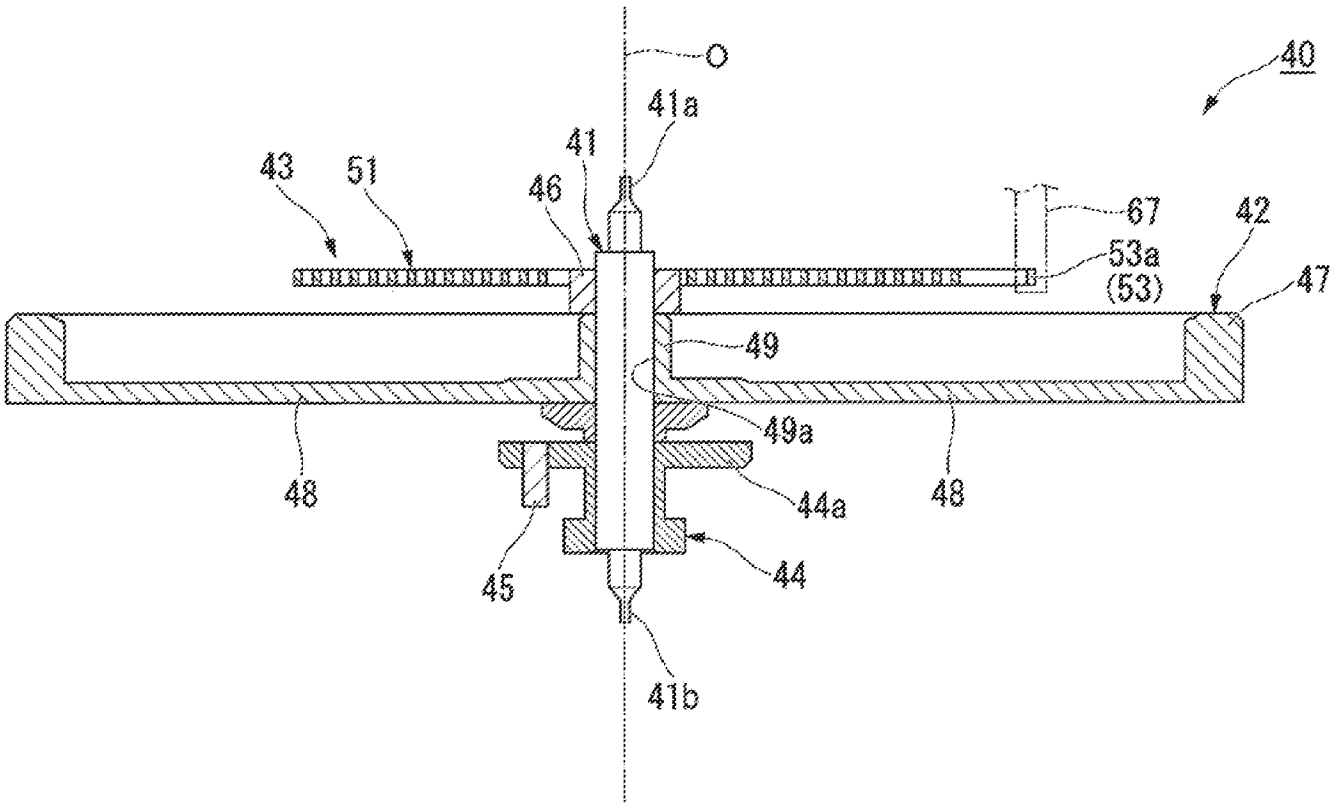
FIG. 4 is a sectional view taken along line IV-IV of FIG. 3.

FIG. 3 is a plan view of the balance with a hairspring according to the first embodiment. FIG. 4 is a sectional view taken along line IV-IV of FIG. 3.

As illustrated in FIGS. 3 and 4, the balance with a hairspring 40 includes a balance staff 41, a balance wheel 42, and a hairspring 43. The balance with a hairspring 40 uses the power of the hairspring 43 to reciprocate (rotate forwardly and rearwardly) around a central axis O of the balance staff 41 with a certain vibrating period (oscillation angle). In the embodiment, a direction along the central axis O of the balance staff 41 is referred to as a shaft direction, a direction orthogonal to the central axis O and extending radially from the central axis O is referred to as a radial direction, and a direction around the central axis O in a plan view when viewed from the shaft direction is referred to as a circumferential direction.

The balance staff 41 is formed of a metal material, such as brass, for example, and is a rod-like member that extends along the central axis O. A tapered first tenon 41*a* and a second tenon 41*b* are formed at both ends of the balance staff 41 in the shaft direction. The balance staff 41 is pivotally supported between the main plate 11 and a balance bridge (not illustrated) via the first tenon 41*a* and the second tenon 41*b*. The balance staff 41 has a substantially center part in the shaft direction fixed into a fitting hole 49*a* (which will be described later) of the balance wheel 42 by, for example, press-fitting. Accordingly, the balance staff 41 and the balance wheel 42 are fixed integrally.

An annular double roller 44 is externally fitted to the balance staff 41 coaxially to the central axis O at a part positioned closer to the second tenon 41*b* than the balance wheel 42. The double roller 44 has a flange portion 44*a* that projects to the outer side in the radial direction. An impulse pin 45 for swinging the pallet fork 36 is fixed to the flange portion 44*a*. Furthermore, an annular collet 46 for fixing the hairspring 43 is externally fitted to the balance staff 41 at a part positioned closer to the first tenon 41*a* than the balance wheel 42.

The balance wheel 42 includes an annular rim portion 47 that surrounds the balance staff 41 from the outer side in the radial direction, and an arm portion 48 that couples the rim portion 47 and the balance staff 41 to each other in the radial direction. The rim portion 47 is disposed coaxially to the central axis O. The rim portion 47 is formed of a metal material, such as brass. A plurality of arm portions 48 extend in the radial direction and are arranged at intervals in the circumferential direction. In the example illustrated in the drawing, four arm portions 48 are arranged at intervals of 90 degrees around the central axis O. However, the number, arrangement, and shape of the arm portions 48 are not limited to this case.

The outer end portions of each arm portion 48 in the radial direction are integrally coupled to the inner circumferential portion of the rim portion 47. The inner end portions of each arm portion 48 in the radial direction are connected to each other and integrated. In a coupling portion 49 in which the inner end portions of each arm portion 48 are integrated with each other, the fitting hole 49*a* coaxial to the central axis O is formed. As described above, the balance staff 41 is fixed into the fitting hole 49*a* by, for example, press-fitting.

The hairspring 43 is a thin plate spring formed of a metal material. The hairspring 43 is made of, for example, iron or nickel. The hairspring 43 is formed in a spiral shape within a vertical surface of the central axis O. The inner end portion of the hairspring 43 is fixed to the balance staff 41 via the collet 46. A part of the outermost circumferential portion of the hairspring 43 is spaced to the outer side in the radial direction via a reformed portion 55 which will be described later, and the radius of curvature is formed to be larger than that of the part positioned at the inner circumference of the reformed portion 55. The outer end portion of the hairspring 43 is fixed to a stud 67 attached via a stud holder (not illustrated).

Figure 5:
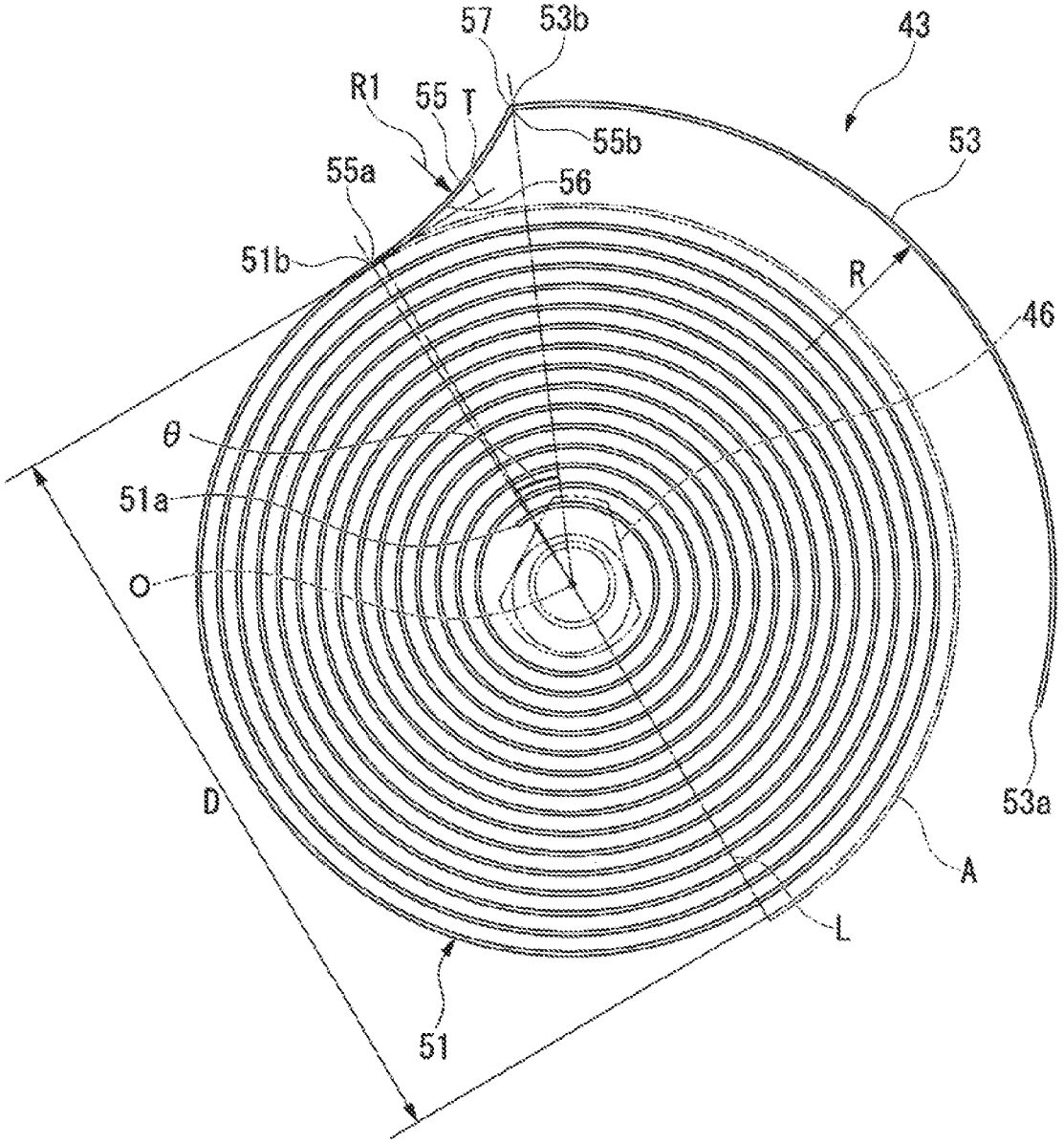
FIG. 5 is a plan view of a hairspring according to the first embodiment.

FIG. 5 is a plan view of the hairspring according to the first embodiment.

As illustrated in FIG. 5, the hairspring 43 includes a main body portion 51 that extends along an Archimedes curve when viewed from the shaft direction around the central axis O, an outer end curve portion 53 that extends along the circumferential direction on the outer side of the main body portion 51 in the radial direction, and the reformed portion 55 that connects the main body portion 51 and the outer end curve portion 53 to each other.

The main body portion 51 is wound with a plurality of turns so as to be adjacent to each other at substantially equal intervals in the radial direction when viewed from the shaft direction. In the example illustrated in the drawing, using an inner end portion 51*a* as an unwinding position, unwinding proceeds along the Archimedes curve with the central axis O as a polar coordinate origin when viewed from the shaft direction, and the main body portion 51 is formed with 15 windings. The inner end portion 51*a* of the main body portion 51 is an inner end portion of the hairspring 43. Hereinafter, among the circumferential directions, a direction in which the main body portion 51 extends from the inner end portion 51*a* is referred to as an unwinding direction of the main body portion 51.

The outer end curve portion 53 is the outermost circumferential portion of the hairspring 43. The outer end curve portion 53 extends around the central axis O with a certain curvature. The outer end curve portion 53 is formed in an arc shape having a radius of curvature larger than that of the main body portion 51. The "radius of curvature" in each portion of the hairspring 43 is a reciprocal number of the curvature of a concave surface at a target part. A first end portion 53*a* of the outer end curve portion 53 is an outer end portion of the hairspring 43. A second end portion 53*b* of the outer end curve portion 53 is provided at a position deviated from the outer end portion 51*b* of the main body portion 51 by a predetermined angle in the unwinding direction of the main body portion 51.

The reformed portion 55 connects the outer end portion 51*b* of the main body portion 51 and the second end portion 53*b* of the outer end curve portion 53 to each other. The reformed portion 55 extends from the outer end portion 51*b* of the main body portion 51 to the outer side in the radial direction and in the unwinding direction of the main body portion 51, and is coupled to the second end portion 53*b* of the outer end curve portion 53. The reformed portion 55 includes a first bent portion 56 that is bent outward in the radial direction from a tangent line T of the Archimedes curve in a first connection portion 55*a* with the main body portion 51, and a second bent portion 57 that is bent inward in the radial direction from the outer end curve portion 53 in a second connection portion 55*b* with the outer end curve portion 53. At least one of the first bent portion 56 and the second bent portion 57 is curved. In the embodiment, only the first bent portion 56 of the first bent portion 56 and the second bent portion 57 is curved. In other words, the first bent portion 56 is curved and the second bent portion 57 is bent. The first bent portion 56 is curved with a certain curvature. The radius of curvature of the first bent portion 56 is larger than the thickness of the hairspring 43 at the reformed portion 55. The first bent portion 56 is smoothly connected to the main body portion 51 when viewed from the shaft direction. In addition, "smooth connection" means connection in a state where a gradient of the tangent line is continuous without being curved. The first bent portion 56 and the second bent portion 57 are connected to each other.

When describing the dimensions and angles of each part in the hairspring 43 of the embodiment in detail, the original shape of the hairspring 43 will be described. The original shape of the hairspring 43 is not deformed by the reformed portion 55 and the entire hairspring 43 has a shape that extends along the Archimedes curve. In other words, the original shape of the hairspring 43 is a shape in which the part that configures the reformed portion 55 and the outer end curve portion 53 in the hairspring 43 further extends along the Archimedes curve from the outer end portion 51*b* of the main body portion 51 as illustrated by a two-dot chain line A in the drawing.

An inner diameter of the outermost circumferential portion of the original shape of the hairspring 43 is defined as a time diameter D on a virtual straight line L that passes through the central axis O and the outer end portion of the original shape of the hairspring 43 when viewed from the shaft direction. In a case where the time diameter D satisfies 3.5 mm≤D 5.5 mm, the radius of curvature R of the outer end curve portion 53 satisfies 0.25 mm≤R−(D/2)≤0.65 mm, and a center angle θ on the central axis O between both ends of the reformed portion 55 satisfies 10°≤θ≤35°, it is desirable that a radius of curvature R1 of the first bent portion 56 satisfies 0.35 mm≤R1≤10 mm. Furthermore, it is more desirable that the radius of curvature R1 of the first bent portion 56 satisfies 3 mm≤R1≤7 mm. Accordingly, the maximum value of the stress generated in the first bent portion 56 can be relaxed by 20% or more.

As described above, the hairspring 43 of the embodiment includes the reformed portion 55 that connects the main body portion 51 and the outer end curve portion 53 to each other. The reformed portion 55 includes the first bent portion 56 that is bent outward in the radial direction from the tangent line T of the Archimedes curve in the first connection portion 55*a* with the main body portion 51, and the second bent portion 57 that is bent inward in the radial direction from the outer end curve portion 53 in the second connection portion 55*b* with the outer end curve portion 53. The first bent portion 56 is curved.

According to the configuration, by forming the reformed portion 55 including the first bent portion 56 and the second bent portion 57, for example, by performing bending processing or the like with respect to a part of a spiral thin plate spring (original shape of the hairspring 43), it is possible to provide the outer end curve portion 53 spaced to the outer side in the radial direction from the main body portion 51 at the outermost circumferential portion of the hairspring 43 as a part engaged with the regulator or the like. In such a configuration, since the first bent portion 56 is curved, compared to a case where the first bent portion and the second bent portion are bent, it is possible to suppress stress concentration generated in the reformed portion 55. Therefore, it is possible to provide the hairspring 43 in which deformation due to stress concentration is suppressed while suppressing an increase in manufacturing cost due to addition of heat treatment or the like.

In the embodiment, the outer end curve portion 53 is spaced from the main body portion 51 by the reformed portion 55 having the first bent portion 56 and the second bent portion 57. The hairspring having such a shape is formed, for example, by reforming the thin plate spring by plastic deformation. Here, in the hairspring that does not have the first bent portion that is bent outward in the radial direction from the tangent line of the Archimedes curve, a bending amount (angle) when the outer end curve portion is spaced from the main body portion is minute. Therefore, the thin plate spring cannot be sufficiently plastically deformed, and there is a possibility that the position accuracy of the outer end curve portion deteriorates. According to the embodiment, since the first bent portion 56 and the second bent portion 57 are provided, it is possible to easily reform the thin plate spring by plastic deformation when forming the hairspring 43, and it is possible to improve the accuracy of the position and shape of the outer end curve portion 53.

In addition, the first bent portion 56 is curved with a certain curvature.

According to the configuration, the stress generated in the first bent portion 56 can be dispersed substantially evenly in a curved range with a certain curvature. Therefore, the deformation of the hairspring 43 due to stress concentration can be more reliably suppressed.

Here, the effectiveness of stress relaxation by providing the hairspring with a bent portion curved with a certain curvature will be described.

Figure 6:
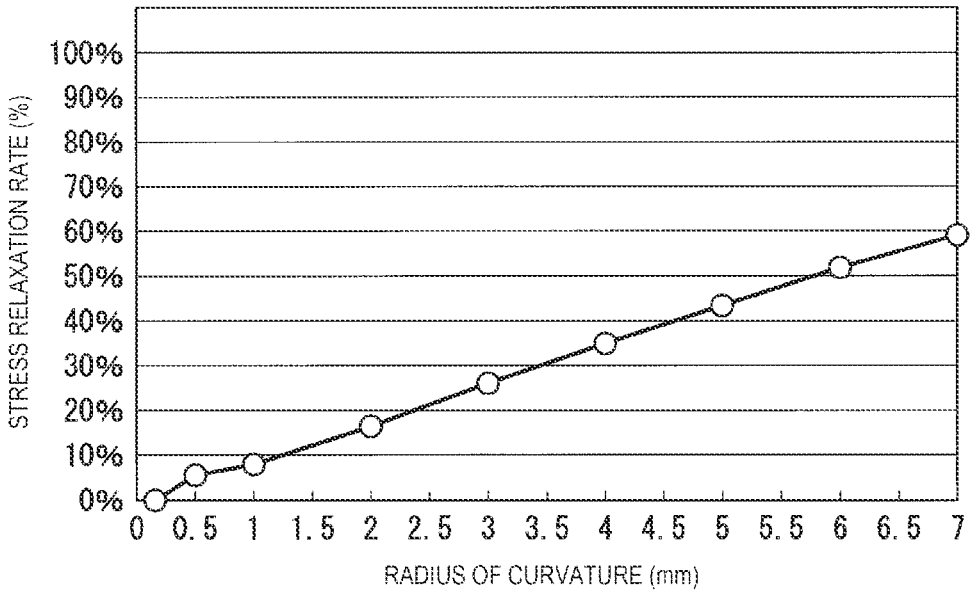
FIG. 6 is a graph illustrating a relationship between a radius of curvature and a stress relaxation rate of a bent portion, where the bent portion curved with a certain curvature is provided at a part of the hairspring.

FIG. 6 is a graph illustrating a relationship between a radius of curvature and a stress relaxation rate of a bent portion, where the bent portion curved with a certain curvature is provided at a part of the hairspring. In FIG. 6, the horizontal axis indicates the radius of curvature of the bent portion. The longitudinal axis indicates a reduction rate of the maximum value of the stress in a case where the radius of curvature of the bent portion is 0.15 mm as the stress relaxation rate. The results illustrated in FIG. 6 are the results in a case where the width of the hairspring is 0.078 mm and the thickness of the hairspring is 0.028 mm.

As illustrated in FIG. 6, it is possible to confirm that the relaxation rate of the stress increases as the radius of curvature of the bent portion increases. Therefore, in the embodiment, it has been confirmed that the stress concentration generated in the reformed portion 55 can be suppressed by curving the first bent portion 56 with a certain curvature.

Furthermore, according to the balance with a hairspring 40 of the embodiment, since the above-described hairspring 43 is provided, the high-quality and inexpensive balance with a hairspring 40 with less variation in rate due to deformation of the hairspring 43 can be obtained.

Furthermore, according to the movement 10 and the timepiece 1 of the embodiment, since the above-described balance with a hairspring 40 is provided, the high-quality movement 10 and timepiece 1 with little time error can be obtained.

Second Embodiment

Next, a second embodiment will be described with reference to FIG. 7. The second embodiment is different from the first embodiment in that a reformed portion 155 includes a straight portion 158 between a first bent portion 156 and a second bent portion 157. In addition, the configuration other than that described below is the same as that of the first embodiment.

Figure 7:
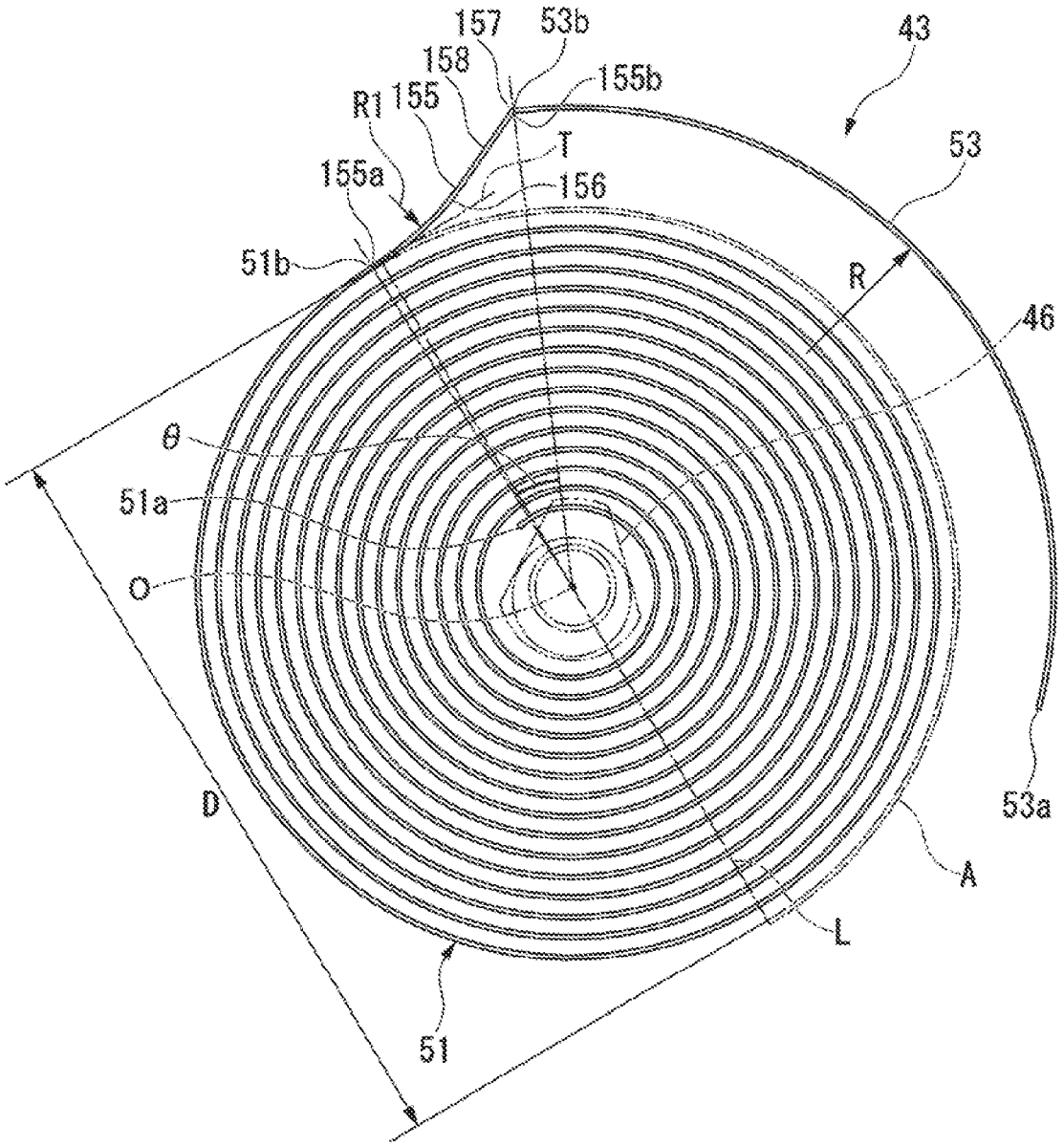
FIG. 7 is a plan view of a hairspring according to a second embodiment.

FIG. 7 is a plan view of the hairspring according to the second embodiment.

As illustrated in FIG. 7, the reformed portion 155 includes a first bent portion 156 that is bent outward in the radial direction from the tangent line T of the Archimedes curve in a first connection portion 155*a* with the main body portion 51, a second bent portion 157 that is bent inward in the radial direction from the outer end curve portion 53 in a second connection portion 155*b* with the outer end curve portion 53, and a straight portion 158 that connects the first bent portion 156 and the second bent portion 157 to each other. In the embodiment, only the first bent portion 156 of the first bent portion 156 and the second bent portion 157 is curved. The first bent portion 156 is curved with a certain curvature. The straight portion 158 extends linearly when viewed from the shaft direction. The straight portion 158 extends from the outer end portion of the first bent portion 156 to the outer side in the radial direction and in the unwinding direction of the main body portion 51, and is coupled to the second bent portion 157. The straight portion 158 is smoothly connected to the first bent portion 156 when viewed from the shaft direction. In addition, it is desirable that the time diameter D, the radius of curvature R of the outer end curve portion 53, the center angle θ between both ends of the reformed portion 155, and the radius of curvature R1 of the first bent portion 156 satisfy the same conditions as those in the first embodiment.

As described above, since the hairspring 43 according to the embodiment includes the first bent portion 156 curved with a certain curvature, the same operational effects as those of the hairspring 43 according to the first embodiment can be achieved.

Third Embodiment

Next, a third embodiment will be described with reference to FIG. 8. The third embodiment is different from the first embodiment in that a first bent portion 256 is bent and a second bent portion 257 is curved. In addition, the configuration other than that described below is the same as that of the first embodiment.

Figure 8:
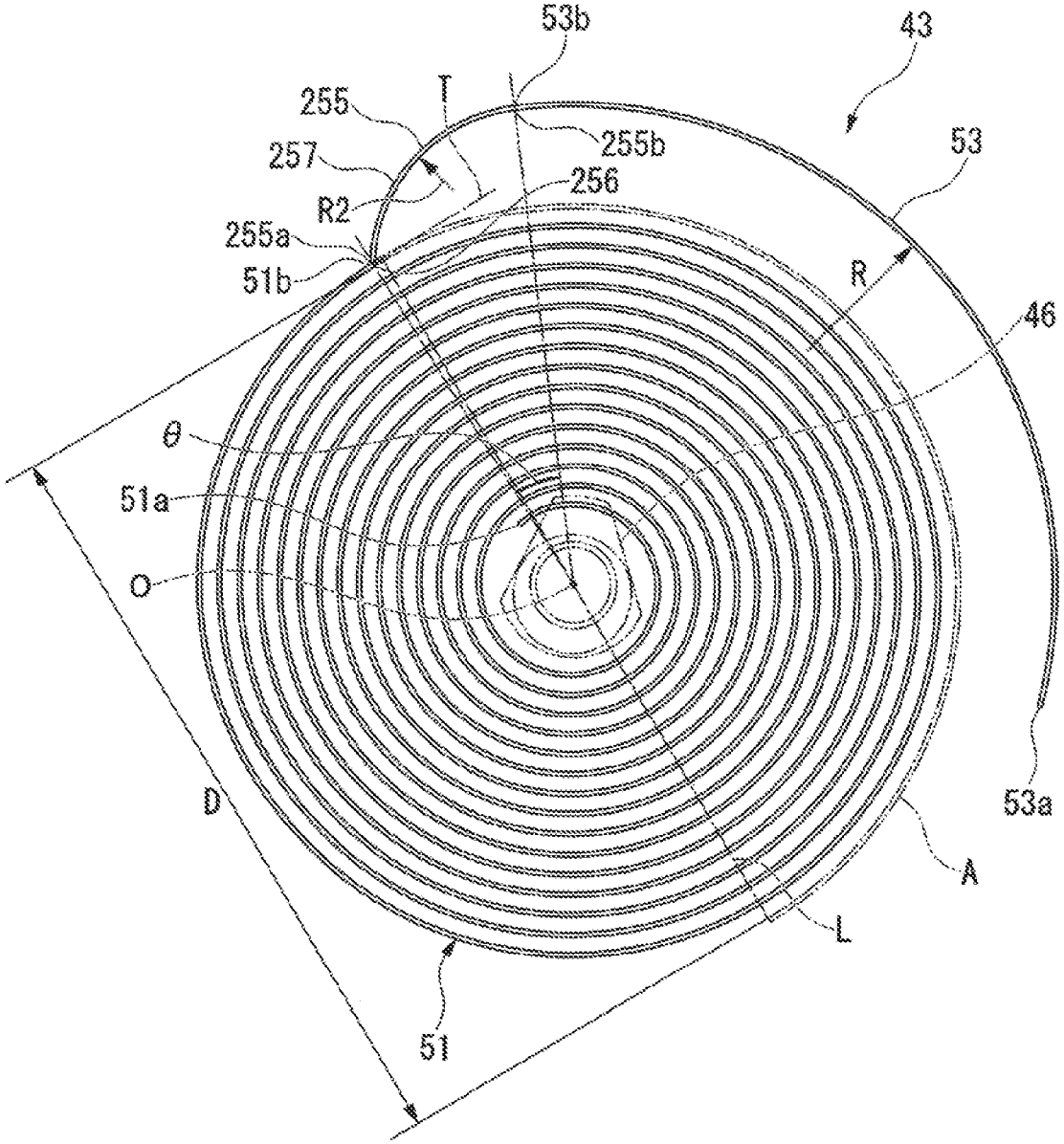
FIG. 8 is a plan view of a hairspring according to a third embodiment.

FIG. 8 is a plan view of the hairspring according to the third embodiment.

As illustrated in FIG. 8, a reformed portion 255 includes the first bent portion 256 that is bent outward in the radial direction from the tangent line T of the Archimedes curve in a first connection portion 255*a* with the main body portion 51, and the second bent portion 257 that is bent inward in the radial direction from the outer end curve portion 53 in a second connection portion 255*b* with the outer end curve portion 53. In the embodiment, only the second bent portion 257 of the first bent portion 256 and the second bent portion 257 is curved. The second bent portion 257 is curved with a certain curvature. The second bent portion 257 is smoothly connected to the outer end curve portion 53 when viewed from the shaft direction. The first bent portion 256 and the second bent portion 257 are connected to each other. In a case where the time diameter D, the radius of curvature R of the outer end curve portion 53, and the center angle θ between both ends of the reformed portion 255 satisfy the same conditions as those in the above-described first embodiment, it is desirable that a radius of curvature R2 of the second bent portion 257 satisfies 0.3 mm≤R2≤2 mm. Furthermore, it is more desirable that the radius of curvature R2 of the second bent portion 257 satisfies 0.5 mm≤R2≤1 mm. Accordingly, the maximum value of the stress generated in the second bent portion 257 can be relaxed by 20% or more.

As described above, since the hairspring 43 according to the embodiment includes the second bent portion 257 curved with a certain curvature, the same operational effects as those of the hairspring 43 according to the first embodiment can be achieved.

Fourth Embodiment

Next, a fourth embodiment will be described with reference to FIG. 9. The fourth embodiment is different from the third embodiment in that a reformed portion 355 includes a straight portion 358 between a first bent portion 356 and a second bent portion 357. In addition, the configuration other than that described below is the same as that of the third embodiment.

Figure 9:
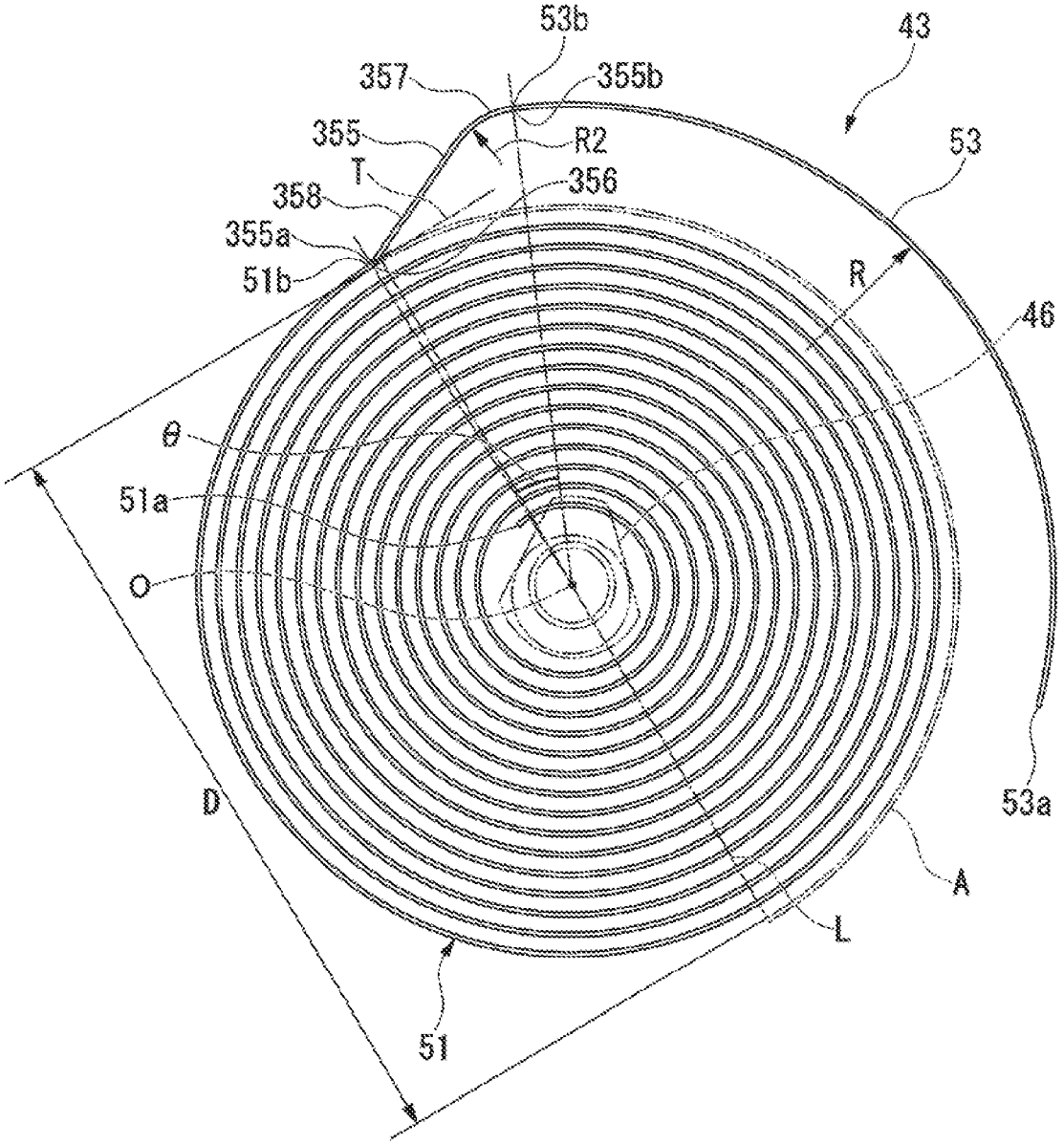
FIG. 9 is a plan view of a hairspring according to a fourth embodiment.

FIG. 9 is a plan view of the hairspring according to the fourth embodiment.

As illustrated in FIG. 9, the reformed portion 355 includes the first bent portion 356 that is bent outward in the radial direction from the tangent line T of the Archimedes curve in a first connection portion 355*a* with the main body portion 51, the second bent portion 357 that is bent inward in the radial direction from the outer end curve portion 53 in a second connection portion 355*b* with the outer end curve portion 53, and the straight portion 358 that connects the first bent portion 356 and the second bent portion 357 to each other. In the embodiment, only the second bent portion 357 of the first bent portion 356 and the second bent portion 357 is curved. The second bent portion 357 is curved with a certain curvature. The straight portion 358 extends linearly when viewed from the shaft direction. The straight portion 358 extends from the inner end portion of the second bent portion 357 to the inner side in the radial direction and in a direction opposite to the unwinding direction of the main body portion 51 in the circumferential direction, and is coupled to the first bent portion 356. The straight portion 358 is smoothly connected to the second bent portion 357 when viewed from the shaft direction. In addition, it is desirable that the time diameter D, the radius of curvature R of the outer end curve portion 53, the center angle θ between both ends of the reformed portion 355, and the radius of curvature R2 of the second bent portion 357 satisfy the same conditions as those in the third embodiment.

As described above, since the hairspring 43 according to the embodiment includes the second bent portion 357 curved with a certain curvature, the same operational effects as those of the hairspring 43 according to the third embodiment can be achieved.

Fifth Embodiment

Next, a fifth embodiment will be described with reference to FIG. 10. The fifth embodiment is different from the first embodiment in that both a first bent portion 456 and a second bent portion 457 are curved. In addition, the configuration other than that described below is the same as that of the first embodiment.

Figure 10:
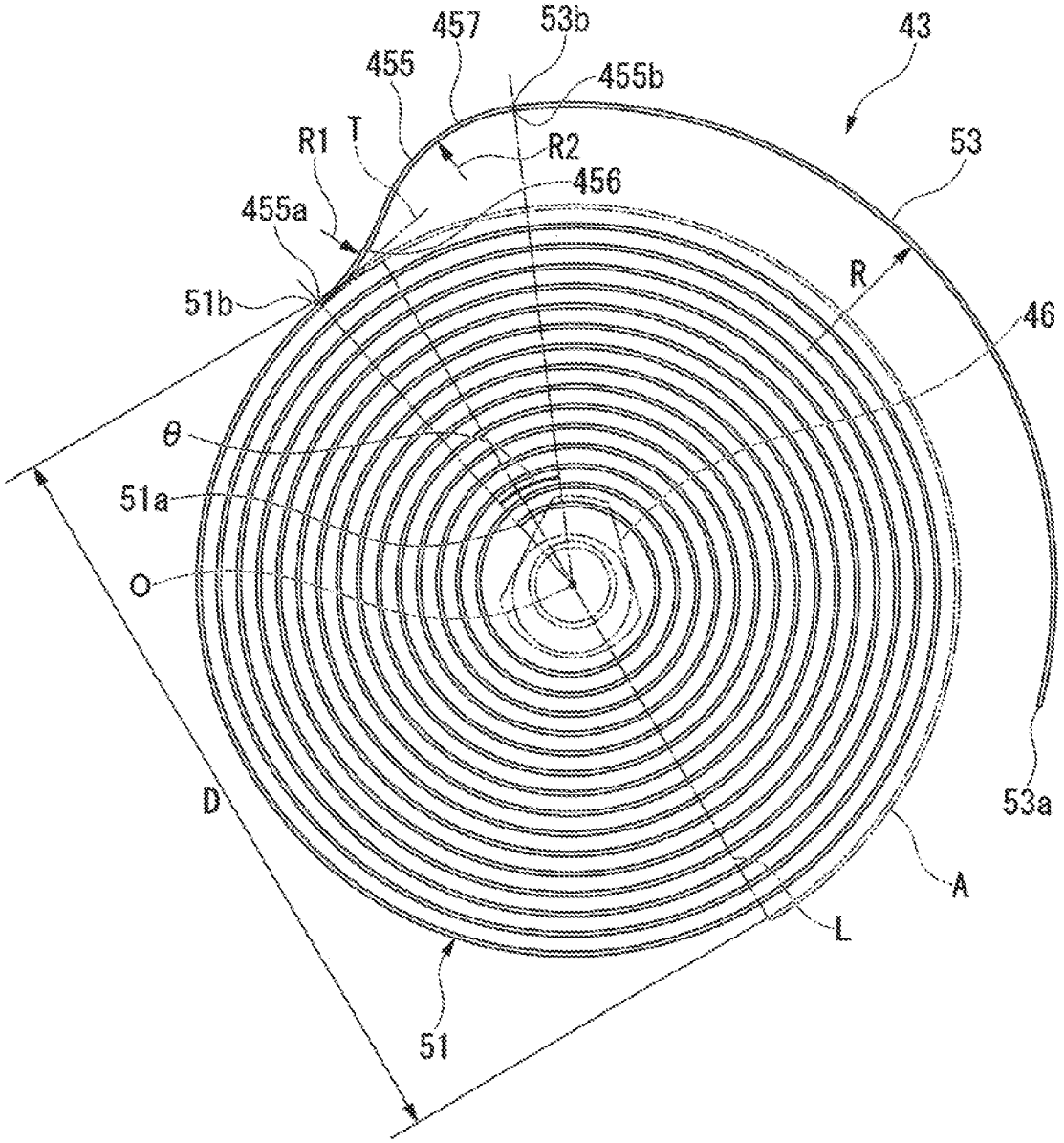
FIG. 10 is a plan view of a hairspring according to a fifth embodiment.

FIG. 10 is a plan view of the hairspring according to the fifth embodiment.

As illustrated in FIG. 10, a reformed portion 455 includes the first bent portion 456 that is bent outward in the radial direction from the tangent line T of the Archimedes curve in a first connection portion 455*a* with the main body portion 51, and the second bent portion 457 that is bent inward in the radial direction from the outer end curve portion 53 in a second connection portion 455*b* with the outer end curve portion 53. In the embodiment, both the first bent portion 456 and the second bent portion 457 are curved. Each of the first bent portion 456 and the second bent portion 457 is curved with a certain curvature. The first bent portion 456 is smoothly connected to the main body portion 51 when viewed from the shaft direction. The second bent portion 457 is smoothly connected to the outer end curve portion 53 when viewed from the shaft direction. The first bent portion 456 and the second bent portion 457 are smoothly connected to each other. For example, the radius of curvature of the first bent portion 456 is larger than the radius of curvature of the second bent portion.

In a case where the time diameter D, the radius of curvature R of the outer end curve portion 53, and the center angle θ between both ends of the reformed portion 455 satisfy the same conditions as those in the above-described first embodiment, it is desirable that the radius of curvature R1 of the first bent portion 456 satisfies 0.35 mm≤R1≤10 mm and the radius of curvature R2 of the second bent portion 457 satisfies 0.3 mm≤R2≤2 mm. Furthermore, it is more desirable that the radius of curvature R1 of the first bent portion 456 satisfies 3 mm≤R1≤7 mm and the radius of curvature R2 of the second bent portion 457 satisfies 0.5 mm≤R2≤1 mm. Accordingly, the maximum value of the stress generated in each of the first bent portion 456 and the second bent portion 457 can be relaxed by 20% or more.

As described above, in the embodiment, both the first bent portion 456 and the second bent portion 457 are respectively curved with a certain curvature. According to the configuration, stress concentration can be suppressed in both the first bent portion 456 and the second bent portion 457. Therefore, the deformation of the hairspring 43 due to stress concentration can be more reliably suppressed.

In addition, the first bent portion 456 and the second bent portion 457 are connected to each other.

According to the configuration, since the entire reformed portion 455 is a curved bent portion, the stress generated in the reformed portion 455 can be dispersed to the entire reformed portion 455. Therefore, the deformation of the hairspring 43 due to stress concentration can be more reliably suppressed.

Sixth Embodiment

Next, a sixth embodiment will be described with reference to FIG. 11. The sixth embodiment is different from the fifth embodiment in that a reformed portion 555 includes a straight portion 558 between a first bent portion 556 and a second bent portion 557. In addition, the configuration other than that described below is the same as that of the fifth embodiment.

Figure 11:
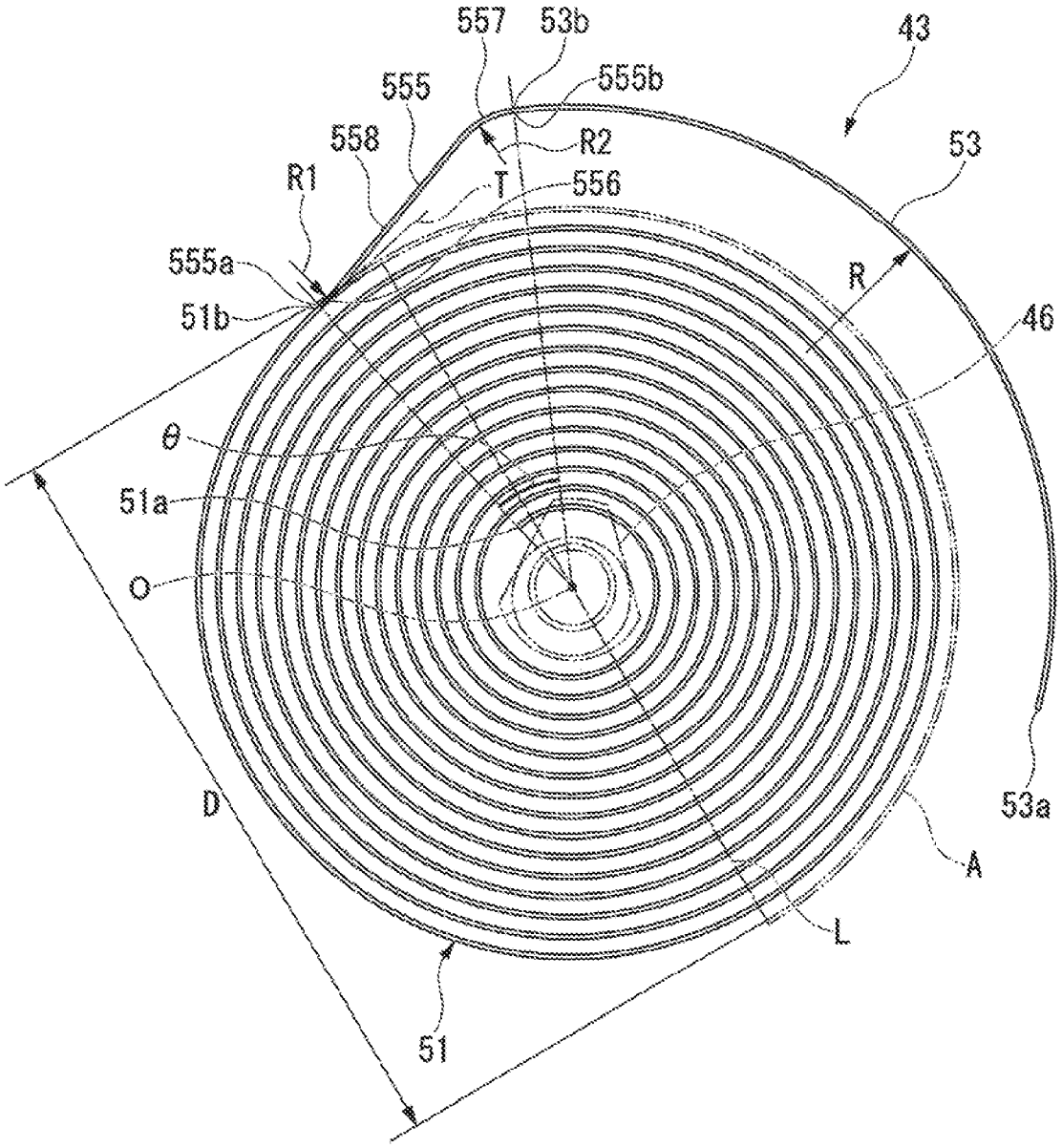
FIG. 11 is a plan view of a hairspring according to a sixth embodiment.

FIG. 11 is a plan view of the hairspring according to the sixth embodiment.

As illustrated in FIG. 11, the reformed portion 555 includes the first bent portion 556 that is bent outward in the radial direction from the tangent line T of the Archimedes curve in a first connection portion 555*a* with the main body portion 51, the second bent portion 557 that is bent inward in the radial direction from the outer end curve portion 53 in a second connection portion 555*b* with the outer end curve portion 53, and the straight portion 558 that connects the first bent portion 556 and the second bent portion 557 to each other. In the embodiment, both the first bent portion 556 and the second bent portion 557 are curved. Each of the first bent portion 556 and the second bent portion 557 is curved with a certain curvature. The straight portion 558 extends linearly when viewed from the shaft direction. The straight portion 558 extends from the outer end portion of the first bent portion 556 to the inner side in the radial direction and in the unwinding direction of the main body portion 51, and is coupled to the inner end portion of the second bent portion 557. The straight portion 558 is smoothly connected to each of the first bent portion 556 and the second bent portion 557 when viewed from the shaft direction. In addition, it is desirable that the time diameter D, the radius of curvature R of the outer end curve portion 53, the center angle θ between both ends of the reformed portion 555, the radius of curvature R1 of the first bent portion 556, and the radius of curvature R2 of the second bent portion 557 satisfy the same conditions as those in the fifth embodiment.

As described above, in the embodiment, since both the first bent portion 556 and the second bent portion 557 are respectively curved with a certain curvature, similar to the fifth embodiment, it is possible to more reliably suppress the deformation of the hairspring 43 due to stress concentration.

In addition, the invention is not limited to the above-described embodiment described with reference to the drawings, and various modification examples can be considered within the technical scope.

For example, in the above-described embodiments, the outer end curve portion 53 extends around the central axis O with a certain curvature, but the invention is not limited thereto. The outer end curve portion may extend along the circumferential direction, and only the curvature may slightly change at a part.

In addition, in the embodiments, although the first bent portion 56 and the second bent portion 57 are formed by plastic deformation, the method for forming the hairspring is not specifically limited. For example, the hairspring may be formed by a micro electro mechanical systems (MEMS) technique, such as electroforming.

In addition, it is possible to replace the configuration element in the above-described embodiment with a known configuration element as appropriate without departing from the spirit of the present invention.

What is claimed is:

1. A hairspring comprising:

a main body portion wound around a central axis along an Archimedes curve, wherein the main body portion has an inner end and an outer end thereof, and the inner end is attached to the central axis;

an outer end curve portion that arcuately extends along a circumferential direction around the central axis outside the main body portion, wherein the outer end curve portion has a first end and a second end thereof; and a reformed portion connecting the outer end of the main body portion and the first end of the outer end curve portion, wherein the reformed portion has a first connection portion connected to the outer end of the main body and is bent radially outward from the outer end of the main body portion in a direction at a first angle from a line tangential to the Archimedes curve at the outer end of the main body portion, and a second connection portion connected to the first end of the outer end curve portion and is bent radially inward in a direction at a second angle from a line tangential to the outer end curved portion at the second end of the outer end curved portion wherein the main body portion has a time diameter D that falls in a range of $3.5\ \text{mm} \leq D \leq 5.5\ \text{mm}$, the outer end curve portion has a radius R that falls in range of $0.25\ \text{mm} \leq R-(D/2) \leq 0.65\ \text{mm}$, and the reformed portion circumferentially extends over an angle θ, which falls in a range of $10° \leq \theta \leq 35°$, at the center axis between both ends of the reformed portion.

2. The hairspring according to claim 1, wherein at least one of the first or second connection portion of the reformed portion is arcuately formed with a certain curvature.

3. The hairspring according to claim 1, wherein both the first and second connection portions are arcuately formed.

4. The hairspring according to claim 3, wherein the first connection portion and the second connection portion are connected to each other.

5. A balance with a hairspring comprising:

the hairspring according to claim 1;

a balance staff fixed to an inner end portion of the hairspring; and a balance wheel fixed to the balance staff.

6. A timepiece movement comprising the balance with a hairspring according to claim 5.

7. A timepiece comprising the timepiece movement according to claim 6.

* * * * *